US005402217A

United States Patent [19]

Kimura et al.

[11] Patent Number: 5,402,217

[45] Date of Patent: Mar. 28, 1995

[54] IMAGE-TRANSFER APPARATUS WITH A TRANSFER CYLINDER HAVING A SPECIFIC SURFACE FORM

[75] Inventors: Takayuki Kimura; Arata Imabayashi, both of Tokyo, Japan

[73] Assignee: Toyo Ink Manufacturing Co., Ltd., Tokyo, Japan

[21] Appl. No.: 101,311

[22] Filed: Aug. 3, 1993

[30] Foreign Application Priority Data

Jan. 8, 1993 [JP] Japan ..... 5-018250

[51] Int. Cl.[6] ..... G03G 15/14

[52] U.S. Cl. ..... 355/273; 101/409; 101/487; 355/279

[58] Field of Search ..... 355/271, 272, 273, 277, 355/279; 100/93 RP, 176; 101/487, 488, 409, 177, 137

[56] References Cited

FOREIGN PATENT DOCUMENTS 60-155494 8/1985 Japan .
60-171159 9/1985 Japan .

*Primary Examiner*—Matthew S. Smith
*Assistant Examiner*—Nestor R. Ramirez
*Attorney, Agent, or Firm*—Wenderoth, Lind & Ponack

[57] ABSTRACT

An image-transfer apparatus for producing an aesthetically fine transfer image includes a platen having a cut-off portion on the surface formed for attaching an image-forming material and a transfer cylinder having a cut-off portion on the surface formed for attaching an image receptor. The apparatus allows the introduction of the image-forming material and the image receptor into a nip formed by the platen and the transfer cylinder by the rotation of the platen and the transfer cylinder to transfer an image formed in a photosensitive layer of the image-forming material to the image receptor heated to a transfer temperature. The transfer cylinder, other than the cut-off portion, has a cylindricity of 100 μm or less, a circumferential deviation, measured in the radial direction of the transfer cylinder, of 60 μm or less and a straightness, measured on a cylinder surface, of 60 μm or less when heated to and kept at a transfer temperature.

6 Claims, 3 Drawing Sheets

IMAGE-TRANSFER APPARATUS WITH A TRANSFER CYLINDER HAVING A SPECIFIC SURFACE FORM

FIELD OF THE INVENTION

The present invention relates to an image-transfer apparatus which can give an aesthetically fine transfer image. More specifically, it relates to an image-transfer apparatus which can give an aesthetically fine multi-color transfer image free of flawed registering.

PRIOR ART

In recent years, single-color or multi-color prepress proofs are increasingly prepared for proof printing, A prepress proof is produced by preparing an image-forming material formed of a substrate and a photosensitive layer coated on one surface of the substrate, exposing the photosensitive layer to form an image, and transferring the image formed in the photosensitive layer to an image receptor such as paper, generally under heat approximately between 80° and 150° C. The above image-forming material is generally formed of a substrate, a photosensitive layer formed on one surface of the substrate, and a protective layer. The substrate and protective film refer to a thin film or sheet formed of a material such as cellulose acetate, polystyrene, polyvinyl chloride or polyethylene terephthalate. The image receptor includes paper and a film.

As the apparatus for producing the above prepress proof, there has been proposed an apparatus for forming a transfer image on an image receptor, generally by attaching image-forming material(s) to a platen, attaching an image receptor to a transfer cylinder, and bringing the platen and the transfer cylinder into contact under pressure such that the image-forming material(s) and the image receptor face each other to transfer image(s) formed in the photosensitive layer(s) to the image receptor in a nip portion formed by the platen and the transfer cylinder. For producing a multi-color printed matter or prepress proof, an original multi-color image is color-separated (color-scanned), then image-forming materials are exposed to form images of colors such as an image of yellow, an image of magenta, an image of cyan and an image of black in photosensitive layers of the image-forming materials, and the images of these colors are consecutively transferred to one image receptor. That is, for producing a prepress proof, etc., one image receptor and a plurality of image-forming materials are used. For this reason, it is required to correctly position a plurality of these image-forming materials against one image receptor in order to obtain an aesthetically fine multi-color image.

For facilitating the registering of each color, it is general practice to use a pin bar as a device for attaching each image-forming material to the platen. The pin bar refers to a plurality of pins provided on a plate extending in the direction of length of the shaft of the platen. When, however, the pin bar is directly provided on the platen, the following problem occurs. That is, there is a distinct difference in height between the platen surface and the pin bar, and the registering accuracy is often insufficient due to nonuniform slackening of the image-forming materials. For overcoming this problem, Applicant (including the present inventors) has proposed an image-transfer apparatus as disclosed in Japanese Patent Application No. 119680/1992, which relates to a position and method for placing a pin bar. In a device for attaching and holding an image-forming material on the platen surface, disclosed in the above Application, a device for attaching the top portion of the image-forming material (that portion of the image-forming material which is attached to the platen in the beginning) is formed of a pin bar constituted by providing pins which are projected from inside a blanket in a partial cut-off portion provided on the platen and a slanting portion continued from the partial cut-off portion. As a result of detailed studies by the present inventors, however, the registering accuracy is not adequately improved although it is improved to some extent.

SUMMARY OF THE INVENTION

It is an object of the present invention to provide an image-transfer apparatus comprising a transfer cylinder to which an image receptor is to be attached and a platen to which an image-forming material is to be attached, which apparatus is capable of achieving excellent registering accuracy to give an aesthetically fine image.

According to the present invention there is provided an image-transfer apparatus which comprises a platen having a cut-off portion on its surface and prepared for attaching an image-forming material and a transfer cylinder having a cut-off portion on its surface prepared for attaching an image receptor, and which allows the introduction of the image-forming material and the image receptor into a nip formed by the platen and the transfer cylinder by the rotation of the platen and the transfer cylinder to transfer an image formed in a photosensitive layer of the image-forming material to the image receptor heated to a transfer temperature.

The transfer cylinder, other than the cut-off portion, has a cylindricity of 100 μm or less, a circumferential deviation, measured in the radial direction of the transfer cylinder, of 60 μm or less and a straightness, measured on a cylinder surface, of 60 μm or less when heated to and kept at a transfer temperature.

Further, there is also provided an image-transfer apparatus of the above type whose transfer temperature is from 80° to 150° C.

Furthermore, there is also provided an image-transfer apparatus of the above type whose transfer cylinder has been manufactured at a temperature which is the same as its transfer temperature.

DETAILED DESCRIPTION OF THE INVENTION

The present invention will be explained in detail hereinafter by reference to drawings.

Figure 1:
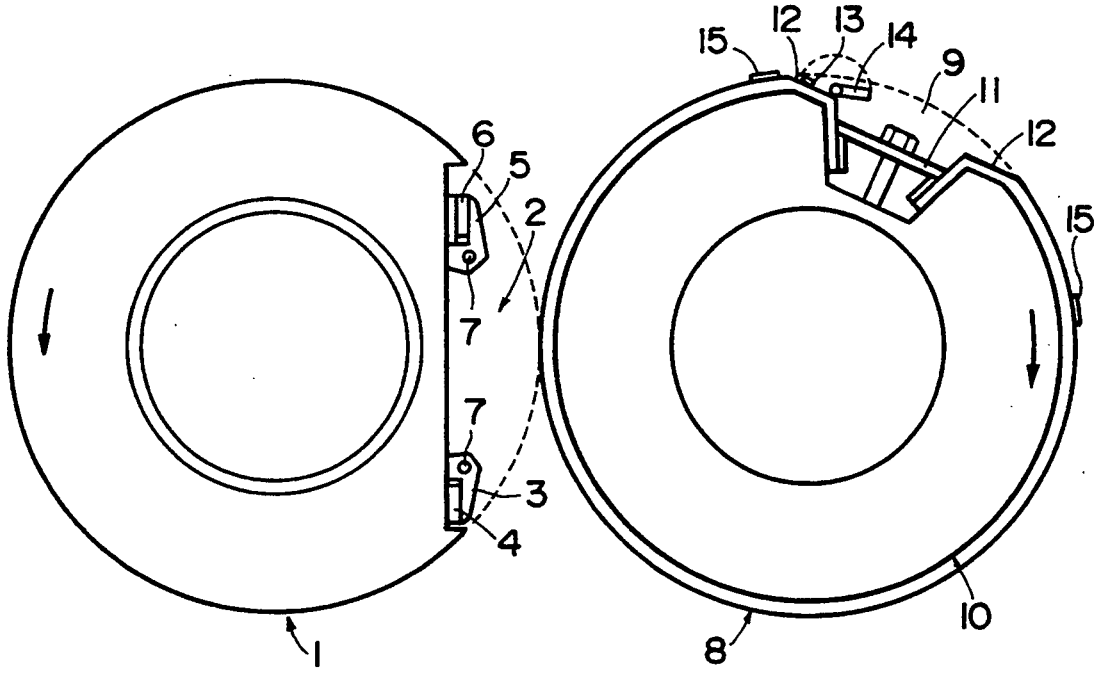
FIG. 1 is a schematic cross section of an image-transfer apparatus.

FIG. 1 is a schematic cross section of an image-transfer apparatus comprising a platen to which an image-forming material suitable for use in the present invention is to be attached and a transfer cylinder to which an image receptor is to be attached. In FIG. 1, numeral 1 indicates the transfer cylinder, numeral 2 indicates a partial cut-off portion, numeral 3 indicates a claw, numeral 4 indicates a claw seat, numeral 5 indicates a claw, numeral 6 indicates a claw seat, and numeral 7 indicates an actuation shaft. The partial cut-off portion 2 is provided on a surface of the transfer cylinder 1, and a leading clamp formed of the claw 3 and the claw sheet 4 for holding the top (leading) end of an image receptor (not shown) and a trailing clamp formed of the claw 5 and the claw seat 6 for holding the bottom (trailing) end of the image receptor are placed in the partial cut-off portion 2. Each of the claws 3 and 5 is provided with the actuation shaft 7 which is manually or electrically actuated, and tile claws are switched to open or close by the rotation of the actuation shaft. The image receptor (not shown) such as paper is attached to the transfer cylinder by holding the top end of the image receptor with the leading clamp, turning the transfer cylinder in the direction indicated by an arrow with tensing the image receptor, and holding the bottom end of the image receptor with the trailing clamp.

Numeral 8 indicates a platen, numeral 9 indicates a partial cut-off portion, numeral 10 indicates a blanket, numeral 11 indicates a blanket fixing device, numerals 12 indicate slanting portions, and numeral 13 is a pin bar. The partial cut-off portion is provided on the surface of the platen 8, and tile blanket 10 coating the surface of the platen 8 is fixed inside the partial cut-off portion 9 with the blanket fixing device 11. Each slanting portion 12 is provided between the partial cut-off portion 9 and a platen surface (circumferential surface). The pin bar 13 is provided in one slanting portion 12. The pin bar is placed by pressing it to the platen surface with the blanket having holes whose positions correspond to the positions of pins. The pin bar 13 has such a height that the top end of the pin bar does not go beyond the circumferential surface of the platen 8. As a result, tile pin bar 13 is not damaged, and the pin bar 13 does not damage the surface of the transfer cylinder 1, when the platen 8 and the transfer cylinder 1 are rotated. A magnet sheet 14, which is tiltable or pivotable, may be provided in the partial cut-off portion 9. Numerals 15 indicate adhesive tapes. One adhesive tape 15 is provided in a place which is on a platen surface and near the slanting portion 12 where the pin bar 13 is provided, and the other adhesive tape 15 is provided in a place which is on a platen surface and near the other slanting portion 12. The magnet sheet 14 has a width such as to cover the pin bar 13 but to end before reaching the former adhesive tape when it is tilted in the direction opposite to the direction of an arrow. An image-forming material (not shown) has holes corresponding to pin places of the pin bar 13, and the image-forming material is placed so that the pins are inserted through the holes. Then, the image-forming material is pressed with the magnet sheet 14, and the platen 8 is rotated in the direction of the arrow. The top end side of the image-forming material is fixed to a platen surface with one adhesive tape 15, and the bottom end side thereof is fixed to a platen surface with the remaining adhesive tape 15.

Figure 2:
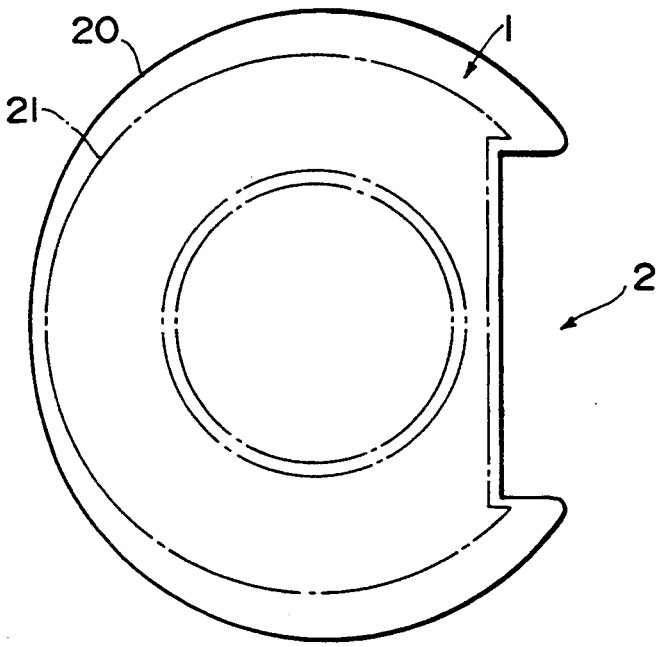
FIG. 2 shows a schematic cross section of a transfer cylinder.
Figure 3:
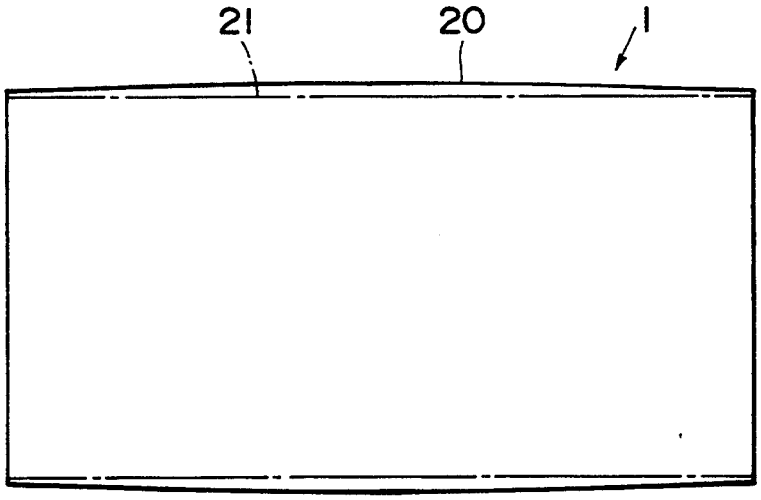
FIG. 3 show s a schematic plan view of a transfer cylinder.

FIG. 2 shows a schematic cross section of the transfer cylinder 1. FIG. 3 shows a schematic plan view of the transfer cylinder. The transfer cylinder 1 is provided with a heating means (not shown) within it. For smoothly transferring an image formed in a photosensitive layer of the image-forming material to an image receptor, the surface of tile transfer cylinder is generally heated to 80° to 150° C. with the heating means. However, a detailed study by tile present inventors has revealed that the surface of the transfer cylinder 1 is expanded nonuniformly in the entirety of the surface, as shown by surfaces 20 in FIGS. 2 and 3. It has been also found that the expansion occurs particularly greatly near a cut-off portion 2. It has been further found that, due to this nonuniform expansion, it is difficult to accurately transfer an image formed in the photosensitive layer of the image-forming material to an image receptor and the registering accuracy of each color in multicolor printing is insufficient.

Figure 4:
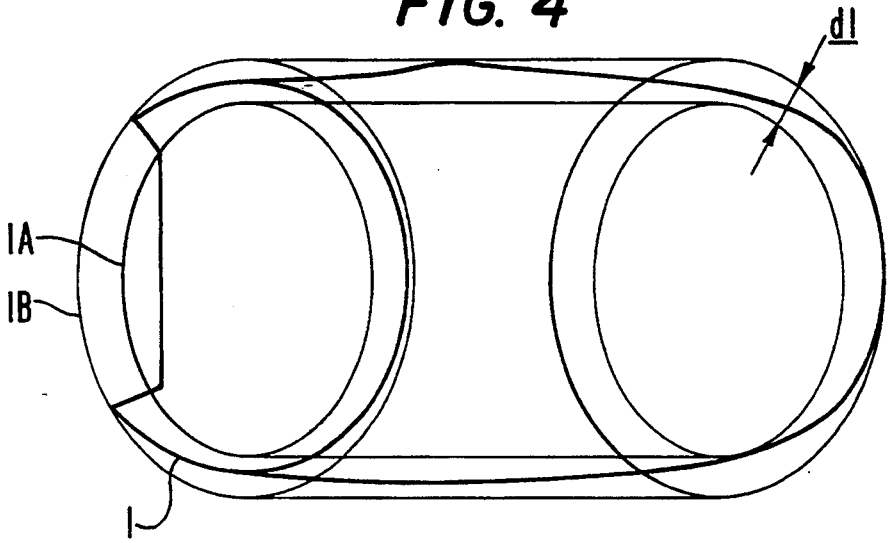
FIG. 4 is a schematic perspective view of a transfer cylinder illustrating cylindricity.
Figure 5:
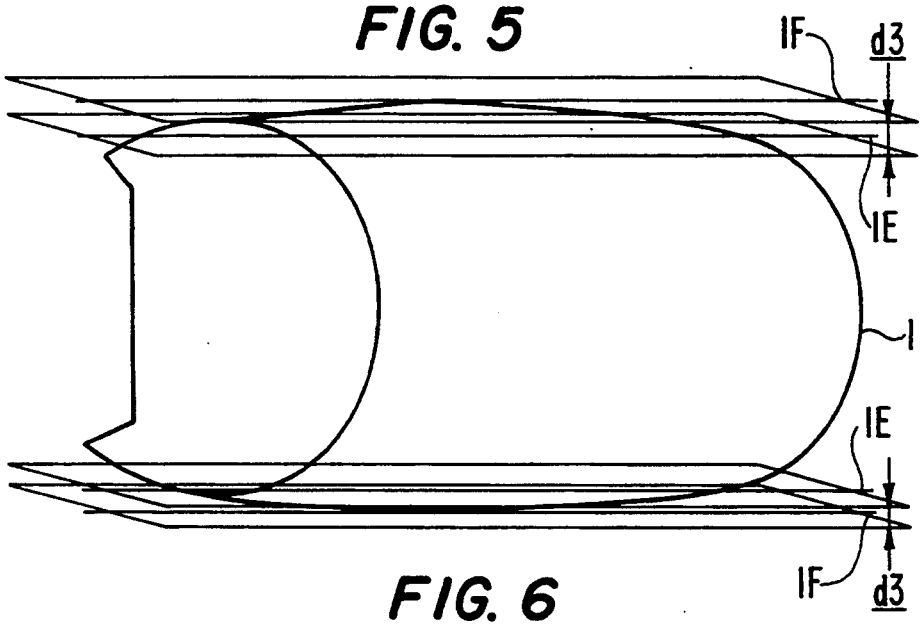
FIG. 5 is a schematic perspective view of a transfer cylinder illustrating straightness.
Figure 6:
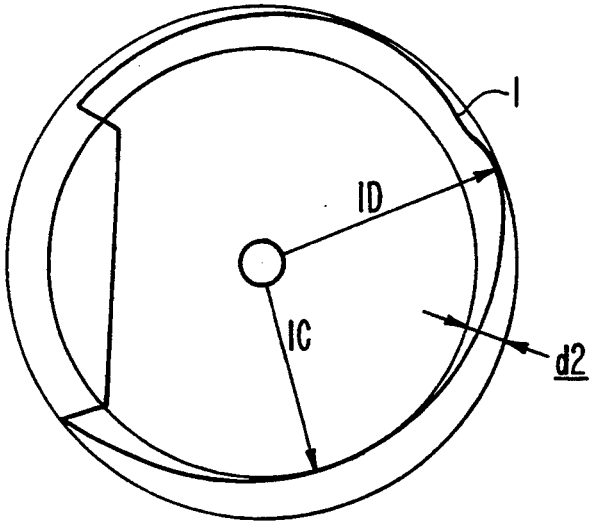
FIG. 6 is a schematic cross-sectional view of a transfer cylinder illustrating circumferential deviation.

On the basis of the above findings, the present inventors have made a further study on the surface form of the transfer cylinder for obtaining an aesthetically fine transfer image, and as a result have found that a transfer image which is satisfactory in practical use and excellent in registering accuracy can be obtained when the following conditions, a, b and c, are satisfied at a transfer temperature.

a. The cylindricity of the cylinder surface of the transfer cylinder other than the cut-off portion is 100 μm or less. The term "cylindricity" refers to the cylindricity defined by JIS B0621. That is, referring to FIG. 4, it is a distance d1 between a geometrically correct cylinder 1A inscribed in the transfer cylinder 1A coaxially with the transfer cylinder and a geometrically correct cylinder 1B circumscribed about the transfer cylinder coaxially with the transfer cylinder, the distance being measured in the radial direction of the transfer cylinder.

b. The circumferential deviation of the transfer cylinder is 60 μm or less. The term "circumferential deviation" refers to that defined by JIS B0621, also known as "circular run-out in radial direction". That is, it is a difference d2 between a maximum distance value 1D and a minimum distance value 1C when distances are measured from a geometrically correct axial line of a transfer cylinder 1 to transfer cylinder surfaces.

c. The straightness, measured on a cylinder surface, is 60 μm or less. The term "straightness" refers to that defined by JIS B0621. That is, referring to FIG. 5, it is a distance between two geometrically correct parallel lines 1E and 1F, one being inscribed in a surface of a transfer cylinder 1, and the other line 1F being circumscribed about the surface of the transfer cylinder 1, and the distance d3 being measured in the radial direction of tile transfer cylinder.

For producing the transfer cylinder 1 whose surface satisfies the above conditions, i.e., whose surface has the form shown by a surface 21 in FIGS. 2 and 3, it is required to take the expansion at a transfer temperature into consideration in processing a transfer cylinder material. At room temperature, however, it is difficult to process the transfer cylinder material so that tile resultant transfer cylinder satisfies the above conditions. It is therefore the most preferred to process the transfer cylinder while heating the transfer cylinder such that the surface of the transfer cylinder has a transfer temperature, i.e., a temperature between 80° and 150° C., whereby the resultant cylinder satisfies the above conditions.

According to the present invention, there is provided an image transfer apparatus which overcomes the defective registering caused by thermal expansion of the transfer cylinder and gives a multi-color prepress proof or a print as an aesthetically fine transfer image.

What is claimed is:

1. An image-transfer apparatus, comprising:

a platen having a platen surface and a cut-off portion on the platen surface;

a transfer cylinder having a transfer cylinder surface and a cut-off portion on the transfer cylinder surface, said platen and said transfer cylinder being rotatable so as to form a nip therebetween for the introduction of an image-forming material and an image receptor for transferring an image formed in a photosensitive layer of the image-forming material to the image receptor at a transfer temperature;

wherein said transfer cylinder, other than said cut-off portion thereof, has a cylindricity of 100 μm or less, a circumferential deviation measured in a radial direction of said transfer cylinder of 60 μm or less and a straightness measured on the transfer cylinder surface of 60 μm or less when said transfer cylinder is heated to and maintained at a transfer temperature.

2. The image-forming apparatus of claim 1, wherein said transfer temperature is set at a temperature selected in the range extending from 80° to 150° C.

3. The image-transfer apparatus of claim 1, wherein said transfer cylinder is manufactured at a temperature that is the same as the transfer temperature.

4. An image-transfer apparatus, comprising:

a rotatable platen having a platen surface and a cut-off portion on the surface;

a rotatable transfer cylinder having a transfer cylinder surface and a cut-off portion on said transfer cylinder surface, said transfer cylinder being disposed adjacent to said platen such that said transfer cylinder and said platen form a nip therebetween during rotation thereof;

wherein said transfer cylinder has the properties of, at a transfer temperature in the range of 80° C. to 150° C., and at said transfer cylinder surface thereof other than said cut-off portion on the said transfer cylinder surface, a cylindricity of no more than 100 μm, a circumferential deviation measured in the radial direction of said transfer cylinder of no more than 60 μm and a straightness measured on said transfer cylinder surface of no more than 60 μm.

5. The image-transfer apparatus of claim 4, wherein said transfer cylinder has a leading clamp and a trailing clamp disposed in said cut-off portion on said transfer cylinder surface for holding the leading and trailing ends of an image receptor.

6. An image-transfer apparatus made by the process of providing a rotatable platen having a platen surface and a cut-off portion on the surface, manufacturing a rotatable transfer cylinder having a transfer cylinder surface and a cut-off portion on the transfer cylinder surface at a transfer temperature in the range of 80° C. to 150° C. such that the transfer cylinder has the properties of, at the transfer temperature in the range of 80° C. to 150° C., and at the transfer cylinder surface thereof other than said cut-off portion on the transfer cylinder surface, a cylindricity of no more than 100 μm, a circumferential deviation measured in the radial direction of the transfer cylinder of no more than 60 μm and a straightness measured on the transfer cylinder surface of no more than 60 μm, and disposing the transfer cylinder adjacent to said platen such that said transfer cylinder and said platen can form a nip therebetween during rotation thereof.

* * * * *